US005250777A

United States Patent [19]

Fishman

[11] Patent Number: 5,250,777

[45] Date of Patent: Oct. 5, 1993

[54] METHOD AND APPARATUS FOR VARIABLE PHASE INDUCTION HEATING AND STIRRING

[75] Inventor: Oleg Fishman, Maple Glen, Pa.

[73] Assignee: Inductotherm Corp., Kancocas, N.J.

[21] Appl. No.: 943,099

[22] Filed: Sep. 10, 1992

Related U.S. Application Data

[63] Continuation-in-part of Ser. No. 732,869, Jul. 19, 1991, abandoned, which is a continuation-in-part of Ser. No. 503,335, Apr. 2, 1990, abandoned.

[51] Int. Cl.[5] ..... H05B 6/08

[52] U.S. Cl. ..... 219/10.77; 219/10.41; 373/148; 373/150; 363/96; 363/135

[58] Field of Search ..... 219/10.77, 10.75, 10.491, 219/10.41; 373/144, 145, 146, 147, 148, 150; 363/97, 98, 135, 136, 96

[56] References Cited

U.S. PATENT DOCUMENTS

| | | | |
|---|---|---|---|
| 1,943,802 | 1/1934 | Northrup | 373/146 |
| 3,314,670 | 4/1967 | Kennedy | 266/234 |
| 3,414,659 | 12/1968 | Kennedy | 373/146 |
| 3,419,792 | 12/1968 | Kasper et al. . | |
| 3,472,941 | 10/1969 | Floymayr | 373/146 |
| 3,478,156 | 11/1969 | Segsworth | 373/146 |
| 3,536,983 | 10/1970 | Kennedy | 373/146 |
| 3,731,183 | 5/1973 | Johnson et al. . | |
| 3,851,090 | 11/1974 | Folgero et al. | 13/26 |
| 3,913,005 | 10/1975 | Cook . | |
| 4,238,637 | 12/1980 | Bingen et al. | 373/146 |
| 5,012,487 | 4/1991 | Simcock | 219/10.77 |

*Primary Examiner*—Philp H. Leung

*Attorney, Agent, or Firm*—Seidel, Gonda, Lavorgna & Monaco

[57] ABSTRACT

In one embodiment, an induction furnace is disclosed having a crucible, first and second set of induction coils surrounding the crucible and master and slave inverters, whereas in another embodiment, related to a channel-type induction furnace, the lower portion of the crucible houses at least first and second induction coils. The master and slave inverters each have a switching device with known turn-off-time characteristics for generating an alternating polarity output voltage across a load. The master inverter monitors the current, detects the zero-crossing of the current in the first induction coils, and generates a control signal in response to such detection of zero-crossing. The control signal is generated at an interval following the detection of the zero-crossing which is greater than the turn-off-time characteristic of the switching device. The control signal is introduced into a selectable delay line before it is applied to the slave inverter so as to produce a relative phase difference between the output voltages of the master and slaver inverter.

22 Claims, 9 Drawing Sheets

100
120
200
204
206
EDGE DETECTOR
102
162
240
OSCILLATOR
START
242
LOW-POWER DETECTOR
122
208
FLIP FLOP
212
210
ONE SHOT
222
220
218
V-I
216
214
223
221
124 CONTROL SIGNAL
132
TOT min
104
128
224
TRAIL DETECTOR
226
ONE SHOT
228
T-FLIP FLOP
106a
SCR'S
106b

METHOD AND APPARATUS FOR VARIABLE PHASE INDUCTION HEATING AND STIRRING

This application is a continuation-in-part of Ser. No. 07/732,869 filed Jul. 19, 1991, now abandoned, which, in turn, is a continuation-in-part of Ser. No. 07/503,335 filed Apr. 2, 1990, and now abandoned.

FIELD OF THE INVENTION

This invention relates in general to induction furnaces. More particularly, it relates to controlling inverter power to the induction coils for heating efficiency, and for introducing variable phase currents in the induction coils to stir the molten metal within the induction furnace.

BACKGROUND OF THE INVENTION

An induction furnace heats metal by inducing alternating magnetic fields which produce current flows within the metal to cause resistance heating. Such furnaces typically comprise a refractory-lined container, or crucible, surrounded by one or more sets of induction coils connected to an alternating polarity power supply.

It is known that the molten metal can be stirred within the crucible by inducing a low frequency magnetic field in the metal along with the heating field. The low frequency field produces a wave motion and flow in the metal bath. The stirring field can be induced by separate induction coils connected to a lower frequency electrical power source than the heating coils, or by a plurality of heating coils receiving the same frequency electrical power at different phase angles. This invention is related to the latter, as are the following patents.

U.S. Pat. No. 3,472,941 (J. Floymayr) discloses a furnace and method in which a single frequency current source is divided into two or more equal current supply units, with each supply unit connected to one or more primary induction coils surrounding the crucible. The currents supplied to these coils are in phase coincidence at the initiation of the heating cycle and until the metal begins melting; then the current phases are shifted relative to each other to induce a stirring wave along with the continued resistance heating. The phase shift in such prior art furnaces is generally accomplished by closing switches which connect the primary coils in parallel, then adjusting tuning capacitors in the parallel circuits to alter their phase relationships relative to each other. Such an apparatus and process is described in U.S. Pat. No. 3,478,156 (R. S. Segsworth).

In its electrical characteristics, an induction furnace is often visualized as equivalent to a transformer, with the induction coil behaving like a primary coil and the melt charge behaving like a shorted secondary coil. The power released into the melt charge is proportional to the square of the current in the induction coil, and the current induced within the melt charge is equal to the current in the induction coil times the number of turns in the coil. Since metal melt charges almost always have low resistance, providing high power to the melt charge requires either a high number of turns or a high current in the induction coil. These, in turn, yield poor efficiencies. Induction coils usually have low power factors.

To offset high inductance of the coil, it is usual to include a capacitor in the circuit, creating an RLC oscillating circuit. As is well known, the amplitude of an alternating current in an RLC circuit can be controlled by varying its frequency. A given RLC circuit has a resonant frequency at which the current amplitude will reach a maximum value. From an efficiency standpoint, operating an induction furnace at its resonant frequency will maximize the energy transferred into the melt charge. However, it is impractical to operate an induction furnace at its resonant frequency, as will be explained below.

FIG. 1 is a block diagram of the power supply of a typical induction furnace. External power is provided from a commercial source, and is usually in the form of 60 Hz AC from the power mains. The 60 Hz AC is rectified to provide high voltage DC. The DC is fed into an inverter 10, which usually utilizes silicon controlled rectifiers (SCRs) to "chop" the DC voltage into a square wave. The frequency at which the SCRs are fired thus controls the frequency of the resulting square wave. The square wave is fed into the RLC circuit, in which the melt charge and induction coil may be regarded as a core disposed within an inductor L. As is well known, when alternating voltage is fed into an RLC circuit, a sine-wave current flows in the circuit. The frequency of the square wave voltage and the resulting sine-wave current is directly controlled by the frequency of the SCR firing.

FIG. 2 shows a typical type of inverter (such as the inverter shown in FIG. 1), a "full-bridge" inverter 10, connected between the DC source 12 and the RLC circuit 14. (The $n^2R$ term at 14 represents the equivalent resistance of the RLC circuit, taking into account the number of turns n in the coil and the resistance R of the melt.) The full-bridge inverter 10 comprises four diodes 16 as shown, and four SCRs which operate in pairs 18*a*, 18*b*, and 20*a*, 20*b*, respectively. The SCRs operate as switches which complete a circuit when they are "fired" (i.e., rendered conductive) by an external control signal to their gate terminal. In a full-bridge inverter, the SCRs 18*a*, 18*b* and 20*a*, 20*b* are turned on and off in alternating pairs at the desired frequency for the square wave. The arrows in FIG. 2 show the direction of current from the DC source 12 when SCRs 18*a*, 18*b* are fired and SCRs 20*a*, 20*b* are left open (i.e, non-conductive). SCRs 18*a*, 18*b* complete a circuit from which DC from source 12 flows through the RLC from left to right, as can be seen by the arrows. Alternatively, if SCRs 18*a* and 18*b* are in a non-conductive state and SCRs 20*a* and 20*b* are fired, current will flow in the opposite direction through RLC 14. As those skilled in the art will understand, once an SCR is fired it will conduct electric current until the forward current drops below the minimum necessary to sustain conduction. Should the current change direction, the SCR will block reverse conduction, and after a short period to recover its depletion regions, usually 30–70 microseconds, it will again become non-conductive in both directions. This period is called "turn-off-time" or TOT, for short.

FIG. 3 shows a series of curves graphically describing the behavior of the current of FIG. 2 in the course of one and a half cycles of the inverter 10. Curve 100 describes the current associated with the inverter over time, and curve 110 describes the power associated with the inverter over time. The action of inverter 10 can be summarized thus:

At $t_0$: One set of SCRs is fired. Positive current delivered to RLC, resulting in positive power dissipation in the load.

At $t_1$: Sine-curve behavior of RLC causes inverter current to become zero and then negative (shaded area 101*a*). Reversal of current through first set of SCRs causes them to shut off, and current returns through diodes 16. Because current is negative while voltage is still positive, power to RLC becomes negative (shaded area 111*a*). This represents power not dissipated by the load.

At $t_2$: The alternate set of SCRs is fired, reversing the polarity of the voltage across the RLC. Because current and voltage are now both of the same polarity, power is again dissipated in the load.

At $t_3$: Inverter current again crosses zero point and becomes positive (shaded area 101*b*). Because current is positive and voltage is negative, no power is dissipated (shaded area 111*b*).

At $t_4$: First set of SCRs is again fired. Current, voltage, and power are all positive and the cycle begins again.

The above summary will now be explained in detail.

When DC is input into an RLC circuit, oscillations of voltage and current will result. The frequency of these oscillations depends on the specific values of the RLC components, including the properties of the melt charge inside the inductor. When SCR pair 18*a*, 18*b* is fired, current flows through the RLC circuit and the inverter in the direction of the arrows (FIG. 2). Current will gradually build up to its maximum value and then subside to zero, as illustrated in curve 100 of FIG. 3. The total energy passed from the DC source to the melt charge during the interval $t_0$–$t_1$, a half-cycle of oscillation for the RLC circuit, is:

$$E=t_0\int t^1 vi\,dt>0 \tag{1}$$

where v and i are voltage and current in the RLC circuit, respectively.

During this half-cycle, charge accumulates on the capacitor. At time $t_1$, the voltage on the capacitor is larger than the DC voltage. The capacitor begins to discharge, reversing the direction of the current. This reversal of current will be blocked by SCRs 18*a*, 18*b* and cause them to turn off (although current can still return to the DC source through the diodes 16). After the turn-off-time (TOT), SCR pair 18*a*, 18*b*, will become bi-directionally non-conductive. For the period between $t_1$, when the capacitor begins to discharge, and $t_2$, when the other pair of SCRs 20*a*, 20*b* is fired, the extra energy stored in the capacitor is returned to the DC source. The energy returned to the DC source between $t_1$ and $t_2$ is given by:

$$E=t_1\int t^2 v(-i)dt>0 \tag{2}$$

This reversal of current is illustrated in curve 100 of FIG. 3 as the negative portion of the curve between $t_1$ and $t_2$, encompassing shaded area 101*a*.

Normally, in a full-bridge inverter and many other types of inverter, the other pair of SCRs will be fired at some time after the turn-off-time of one pair of SCRs. When the other pair of SCRs 20*a*, 20*b* are fired, the DC from the source 12 flows through the RLC from right to left in FIG. 2, and the capacitor, begins to charge to the opposite polarity. Between points $t_2$ and $t_3$ in curve 100 in FIG. 2, the voltage and current relative to the DC source have the same polarity and therefore the energy transferred to the load is positive:

$$E=t_2\int t^3(-v)(-i)dt>0 \tag{3}$$

In summary, energy is passed from the DC source to the metal charge (via the coil) when the voltage and current have the same polarity. This condition exists, in curve 100, between $t_0$ and $t_1$ and between $t_2$ and $t_3$. During the period $t_1$ to $t_2$, and between $t_3$ and $t_4$, energy is not being passed to the coil but is being returned to the DC source. These periods of negative energy are shown as shaded areas 101*a* and 101*b* in curve 100 and 111*a* and 111*b* in curve 110. Over the period T of an operating cycle (from $t_0$ to $t_4$), the power produced by the inverter can be determined as:

$$P=\frac{1}{T}\,t_0\int t^4 VI\,dt \tag{4}$$

Assuming that the current is a sine wave and the voltage a square wave, as would be the case with such an inverter, the power passed from the inverter to the furnace will be equal to:

$$P=\frac{2}{\pi}\,VI\cos\phi \tag{5}$$

where:

V is the inverter voltage ($=V_{DC}$ for a full-bridge inverter);

I is the amplitude of inverter current;

f is the frequency of SCR firing ($^1/T$)

$\phi=2t/T$ and which is the phase shift between voltage and current;

t is the time interval in which energy is being returned to the DC source.

The key to equation (5) is the relationship of the phase difference $\phi$ and the time interval t within each cycle in which energy is being returned to the DC source. From FIG. 3, it can be seen that for every cycle of inverter current ($t_0$ to $t_4$), there are two periods of equal duration in which power is returned to the source. These periods are the same as the periods between the zero crossing of the current and the zero crossing of the voltage in the inverter, which can be seen by a comparison of the zero crossings of curve 100 and curve 108. It is clear from equation (5) that, for $\phi$ between 0° and 90°, an increase in $\phi$ will cause a decrease in power. Thus, as $\phi$ increases, power passed to the furnace decreases. Maximum power transfer occurs when $\phi=0$.

However, a dangerous condition exists in an RLC circuit at resonance, in which $\omega_1$ equals $\omega_0$; i.e., when the resonant frequency corresponds to the frequency having zero phase shift. Resonance is the point of maximum power transfer, when there is zero phase shift between voltage and current in the inverter. Zero phase shift means, in effect, that one set of SCRs is being turned on at exactly the same instant the other set is being turned off. This would be no problem if SCRs behaved as idealized switches, which open instantly. However, there is a finite period of time, the turn-off time (TOT) during which an SCR is still conductive in the forward direction after being switched off. If the phase shift is less than the TOT of the SCRs, all of the SCRs will be conductive at the same time, thus causing a short across the DC source. Thus, in order to avoid shorting out the power supply, the phase shift between voltage and current must always be greater than the TOT of the SCRs. This amounts to the same thing as preventing the frequency of the DC chopping from approaching too closely to the resonant frequency of the RLC. The design optimization parameters are then: (a) in order to operate efficiently, the frequency of SCR firing should be close to the resonant frequency of the RLC; and (b) in order to operate safely, the frequency of SCR firing must always be safely below the resonant frequency of the RLC.

The engineering problem posed by these parameters is complicated by the fact that the resonant frequency of an induction furnace does not remain constant but may vary considerably in the course of use. The physical properties of the melt charge, which acts as the inductor core, have a direct and significant effect on the resonant frequency of the furnace. These properties include the temperature of the melt charge at any given point of the heating operation, the amount of metal in the furnace at any given time, and the specific composition of the alloy being heated. These properties may vary widely even within the course of a single use of the furnace. It is not uncommon in induction melting to add cold metal to the furnace while a previously added batch is still heating, thus changing the mass, temperature, and crystal structure of the core almost instantaneously, and thereby almost instantaneously changing the resonant frequency.

Of course, the SCR firing frequency could be kept extremely low so that the phase shift will always be greater than TOT, even at resonance. This approach is unacceptable because the power supply would become extremely inefficient. Because it is crucial that the input frequency be less than the resonant frequency, and because the resonant frequency may change so suddenly, a control system to control SCR firing frequency in response to new physical conditions in the furnace is required so that phase shift may be minimized for high efficiency yet never less than TOT to avoid shorting the power supply.

It is theoretically possible to calculate the resonant frequency of an induction furnace at any given instant, given the instantaneous temperature, the mass of the core, and physical properties of the core, and thereby change SCR firing frequency as required; but as a practical matter these parameters are too difficult to measure, and are not suitable as inputs to a control system.

One common attempt at solving this problem was to vary the inverter frequency by using voltage-controlled oscillators to generate pulses at a frequency proportional to a control voltage produced in a closed-loop circuit which measures the output power and compares it with a preset desired value. However, this method has a major drawback in that a frequency control system generally cannot adapt to sudden changes in electromagnetic properties of the furnace. If a cold charge is dropped into the melt, the system is likely to encounter the new resonant frequency before the frequency can change, and the inverter will crash; i.e., encounter short circuit conditions. Special protection circuits to detect such a condition are cumbersome and do not work well.

An object of this invention is to provide an improved induction furnace, and a method of induction melting and stirring, by controlling the SCR firing frequency in the inverters delivering power to the induction coils. Control circuitry in a master inverter monitors the zero-crossings of the current in the inductor coils, and generates an SCR firing signal at a selectable delay interval just exceeding the turn-off-time of the SCRs. This arrangement responds to the resonant frequency of the load in order to maintain high output power level while insuring that the SCRs are not made simultaneously conductive. Additional phase delay is selectably introduced into the firing signals sent to slaved inverters associated with different coils to provide multiphase stirring. Still further, this additional phase delay is adapted to various types of induction furnaces including a dual-loop type.

BRIEF SUMMARY OF THE INVENTION

An induction furnace has a master inverter and one or more slaved inverters, each inverter supplying alternating power to a different induction coil or coils. In a preferred embodiment, a master inverter and one slaved inverter each supply a different pair of coils, with the coils in each pair connected in parallel but oppositely wound, and the four coils are arranged vertically around the crucible with each of the slaved coils interspersed above the master coil which is wound in the same direction.

Each inverter is preferably an identical "full-bridge" SCR inverter in which four SCRs are turned ON and OFF in alternating pairs to produce a square wave at the desired frequency. The master inverter includes phase difference control circuitry which monitors the zero-crossings of the current in its load, then generates a firing signal to the next successive SCR pair at a selectable delay interval which exceeds the turn-off-time of the preceding SCR pair. At the initiation of the heating process and until the metal begins melting, the same firing signal is sent to control the SCRs in the slaved inverter, resulting in a single phase heating interval during which the SCR firing frequency can be controlled closely above the resonant RLC frequency of the load to optimize energy transfer.

Additional variable delay circuitry is provided to the firing signals between the master and slave inverters, such that the firing of the slaved pairs of SCRs can be delayed with respect to the master SCRs, causing a phase shift in the power supplied to the slaved coils up to approximately 90 degrees relative to the power in the master coils. Combining with the 180 degree difference in magnetic fields caused by the oppositely wound induction coils, the phase shift of the supplied electrical power creates vertical phase differences in the magnetic fields which, in turn, advantageously cause a running wave motion in the molten metal bath.

A minimum turn-off-time comparison signal may be fed back to the master inverter delay circuitry from the slave inverters to prevent inadvertent simultaneous firing of all SCRs in a slave inverter. Details of the circuitry will be apparent from the detailed description and drawings which follow and from the co-pending application incorporated by reference.

BRIEF DESCRIPTION OF THE DRAWINGS

The drawings show a form of the invention which is presently preferred for the purpose of illustrating the invention. Thus, it should be understood that the invention is not limited to the precise arrangements and instrumentalities shown.

DETAILED DESCRIPTION OF THE INVENTION

Figure 1:
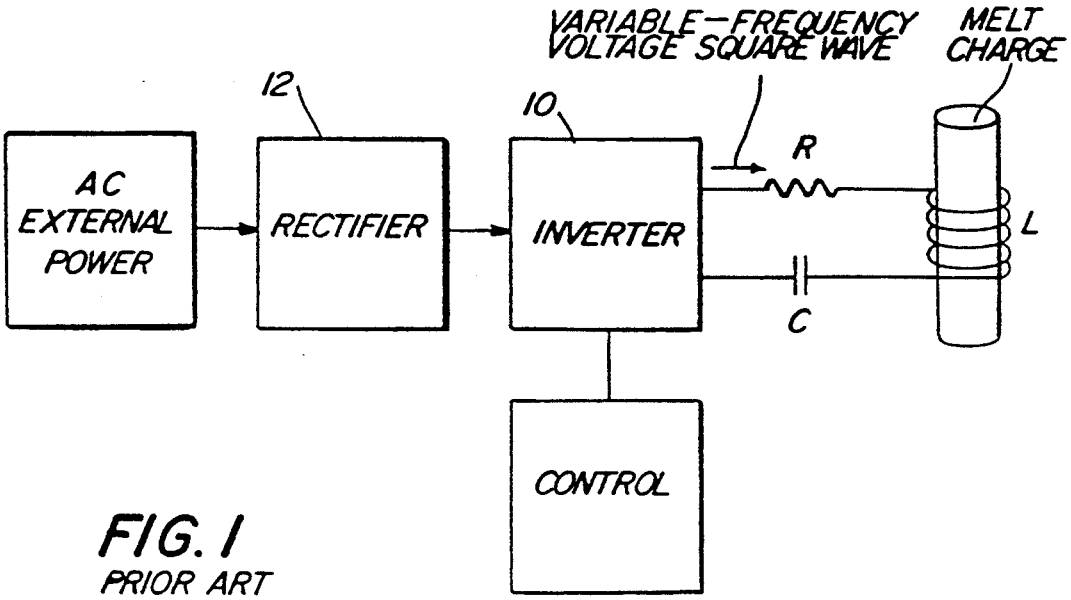
FIG. 1 PRIOR ART
FIG. 1 is a simplified schematic diagram showing the general layout of an inverter power supply for an induction heater according to the prior art.

The improvement of the present invention over the prior art (FIGS. 1 and 2 already described) may be described with references to FIGS. 3–10. The inverter control circuit of the present invention is primarily illustrated in FIGS. 3–6, whereas the practice of the present invention is particularly suited for and may be described with reference to induction furnaces, having a first embodiment illustrated in FIGS. 7 and 8 and second embodiment illustrated in FIGS. 9 and 10.

Figure 7:
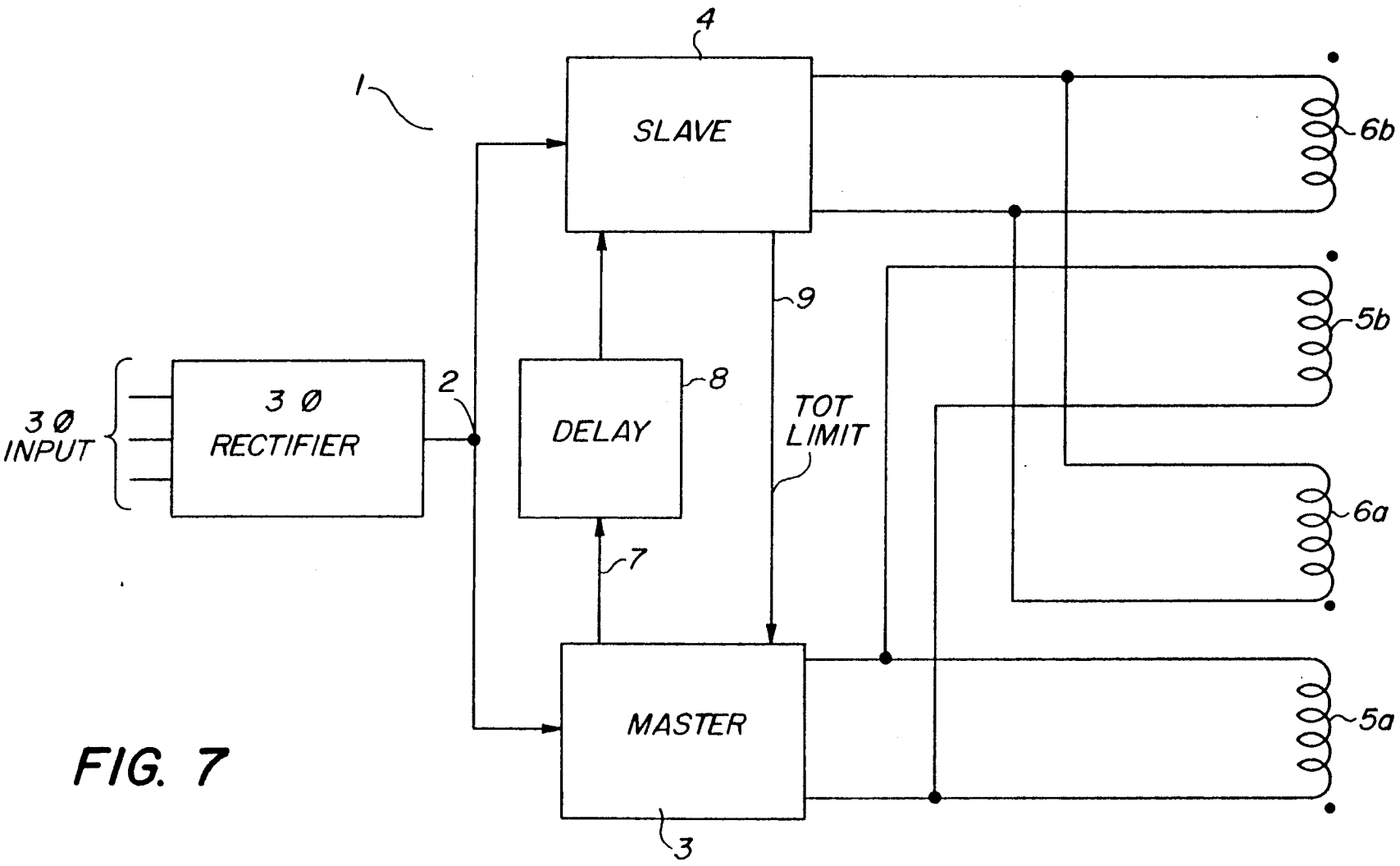
FIG. 7 is a simplified schematic diagram showing the general layout of a two-inverter power supply for an induction furnace according to the invention.

FIG. 7 schematically depicts the power supply 1 of an induction furnace according to the invention. The power supply 1 may receive rectified commercial power supplied to a common bus 2. Both a master inverter 3 and a slaved inverter 4 receive high voltage d.c. input from bus 2. The master inverter 3 supplies alternating power to induction coil pair 5*a* and 5*b*, while slaved inverter 4 supplies power to coil pair 6*a* and 6*b*. (Although one slaved inverter is depicted in this preferred embodiment, alternative embodiments could be made with one or more slaved inverters each supplying separate coils.) It will be understood that the induction coils are disposed around the crucible of the induction furnace (not shown) to induce alternating magnetic fields and resulting current in the metal melt charge.

In the depicted preferred embodiment, the paired coils are connected in parallel, but oppositely wound around the crucible. That is, coil 5*a* and 5*b* are connected in parallel to the output of master inverter 3, but are oppositely wound around the crucible as shown by the polarity indicator dots of FIG. 7. The slaved coils are interspersed above the master coils having the same winding orientation. That is, coil 6*a* is immediately above coil 5*a* and is wrapped in the same direction as coil 5*a*, while coil 6*b* is immediately above coil 5*b* and wrapped in the same direction as coil 5*b*. Thus, as shown by the polarity indicator dots, the magnetic field induced in the lower portion of the crucible surrounded by coils 5*a* and 6*a* is oriented 180 degrees to the field induced in the upper portion of the crucible surrounded by coils 5*b* and 6*b*, even though the power supplied to each of the coils by the inverters may be in phase coincidence with the other coils. However, since the electrical power supplied to slaved coil pair 6*a* and 6*b* can be shifted in phase up to approximately 90 degrees relative to the power supplied to coils 5*a* and 5*b* (as will be described below), the magnetic field in the crucible can exhibit a relative phase difference of 0, 90, 180, and 270 degrees from the bottom of the crucible to its top. As is known in the art, such large and contiguous phase change from bottom to top of the crucible advantageously creates an intense vertical running wave of material along the bottom of the crucible, up one side to its top, along the surface, and then back down the opposite side.

Figure 2:
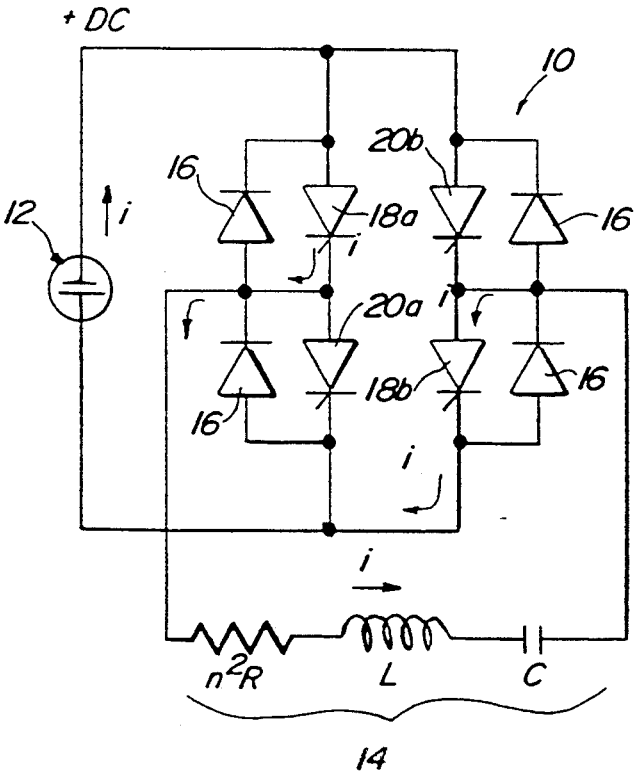
FIG. 2 PRIOR ART
FIG. 2 is a schematic diagram of a full-bridge inverter between a DC source and an RLC load, according to the prior art.

Inverters 3 and 4 are preferably identical "full-bridge" SCR inverters in which four SCRs are turned on and off in alternating pairs to produce a square wave at the desired frequency, as depicted in FIG. 2 and previously described in the "Background" section.

Master inverter 3 further includes phase difference control circuitry which will be described in greater detail hereafter. To understand the general schematic of FIG. 7, it is sufficient to know that the circuitry monitors the zero-crossing of the current in the load for the master coils 5*a* and 5*b*, delays a selectable time period in excess of the turn-off-time (TOT) for the active SCR pair, and then generates a firing signal to the next alternating SCR pair. By selecting a delay just beyond the SCR turn-off-times, the SCR firing frequency can approach, without hazard of matching, the resonant frequency of the load for optimum safe energy transfer.

The SCR firing signal from the master inverter 3 is also sent to control the SCRs of the slaved inverter 4 along line 7, through an additional variable delay circuitry 8. Delay circuitry 8 may be any conventional variable timing device which detects a signal and generates a responsive trigger pulse at a manually selectable time interval thereafter. The device should have a manually selectable time delay up to a desired fraction of the period of the anticipated average inverter cycle; for example, in the depicted two-inverter four-coil embodiment, the device should have a manually selectable delay up to approximately ¼ period (90 degree phase shift). Thus, the slaved inverter voltage may be regulated from phase coincidence with the master inverter through any phase shift up to approximately 90 degrees by the operation of the delay circuitry 8 first receiving a firing signal from the master inverter, and then, sending a delayed firing signal to the slaved inverter. This operation allows the furnace heating to be initiated with both sets of induction coils operating in-phase near the resonant frequency so as to optimize energy transfer; then as the charge in the induction furnace begins to melt, the operator may progressively induce a selected phase difference up to 90 degrees between the coil sets 5 and 6 so as to cause a vertical stirring wave in the molten charge.

It is unlikely that discontinuity or localized changes of the melt charge in the crucible would be so great as to vary the RLC resonant characteristics between coil sets 5 and 6 to the extent that the slave inverter's firing frequency would inadvertently approach too closely to its load's associated resonant frequency and allow simultaneous conduction of its four SCRs. However, to avoid the remote possibility of this occurrence, a turn-off-time comparison signal may be generated in the slaved inverter by detecting the zero-crossings of the current in its coil set 6, and comparing the time interval between that zero-crossing and the next firing signal to the known turn-off-time of the SCRs. When the difference drops below a preset safe limit, a turn-off-time limiting signal (TOT limit) may be fed back to the master inverter control circuitry, as shown by line 9 on FIG. 7, and used to prevent any further decrease in the delay of the firing signals.

Figures 8A, 8B, 8C, 8D, 8E, 8F:
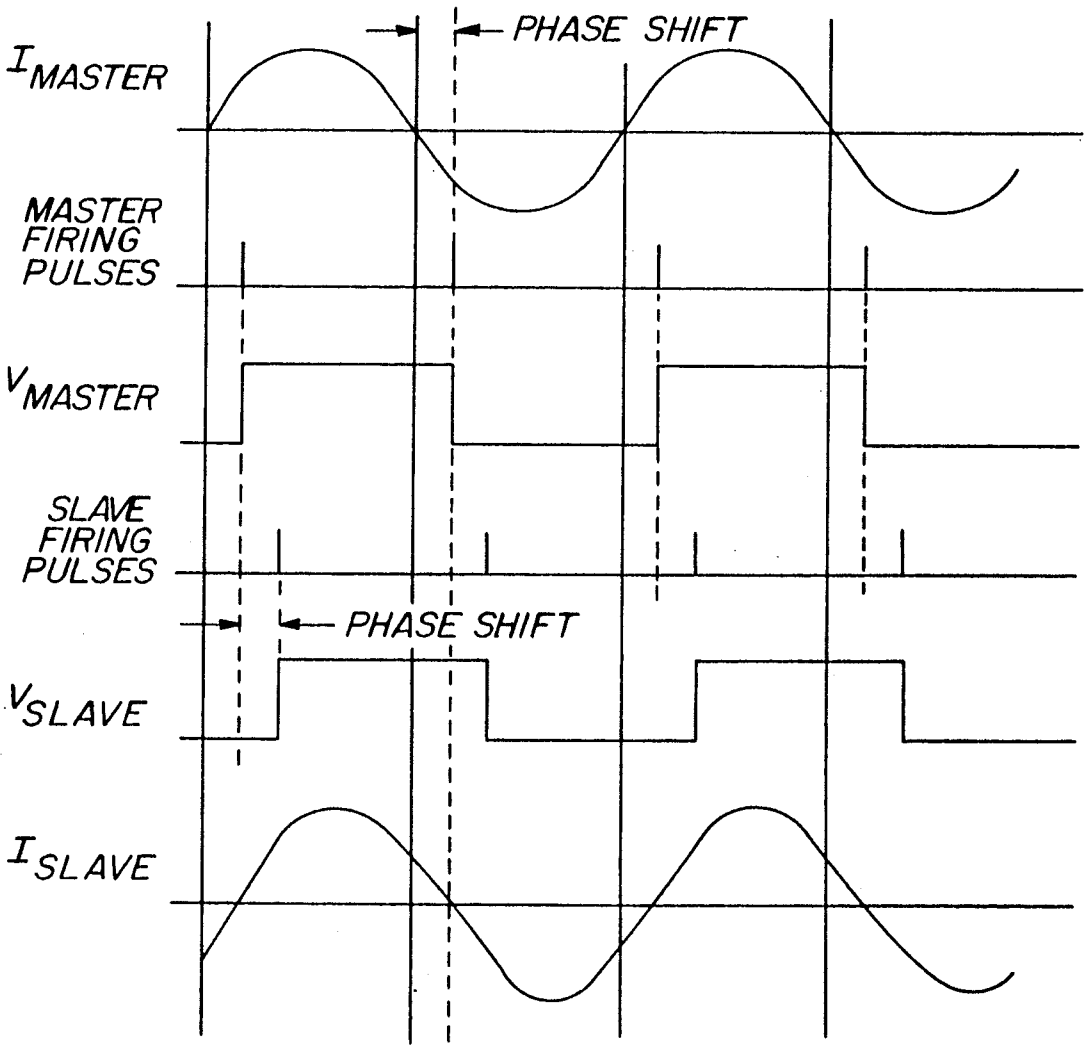
FIG. 8 is composed of FIGS. 8(*a*)–(*f*) illustrating waveforms or pulses related to the phase interrelationship between the master and slave inverters of the present invention.

The phase relationship between the master and slave inverters is illustrated in FIG. 8. FIG. 8 is composed of FIGS. 8(*a*)–(*f*) respectively illustrating the waveshapes or pulses of: (a) $I_{MASTER}$; (b) Master Firing Pulses; (c) $V_{MASTER}$; (d) Slave Firing Pulses; (d) $V_{SLAVE}$; and (e) $I_{SLAVE}$. From FIGS. 8(*b*) and 8(*c*), it is seen that $V_{MASTER}$ (applied to coils 5*a* and 5*b*) is in coincidence with the Master Firing pulses; i.e., the occurrence of a first Master Firing Pulse initiates $V_{MASTER}$, and the occurrence of the next Master Firing Pulse terminates $V_{MASTER}$. This same type of coincidence relationship is shown in FIGS. 8(*d*) and 8(*e*) for the Slave Firing Pulses and $V_{SLAVE}$ (applied across coils 6*a* and 6*b*). The phase difference (previously discussed with reference to FIG. 7) between $V_{MASTER}$ and $V_{SLAVE}$ is shown in FIG. 8(*e*) by the directional arrows, as PHASE SHIFT. This PHASE SHIFT parameter is also present between $I_{MASTER}$ of FIG. 8(*a*) and $I_{SLAVE}$ of FIG. 8(*f*) and is shown in FIG. 8(*a*) by the extension of the phantom lines between FIGS. 8(*a*) and 8(*f*).

Figure 9:
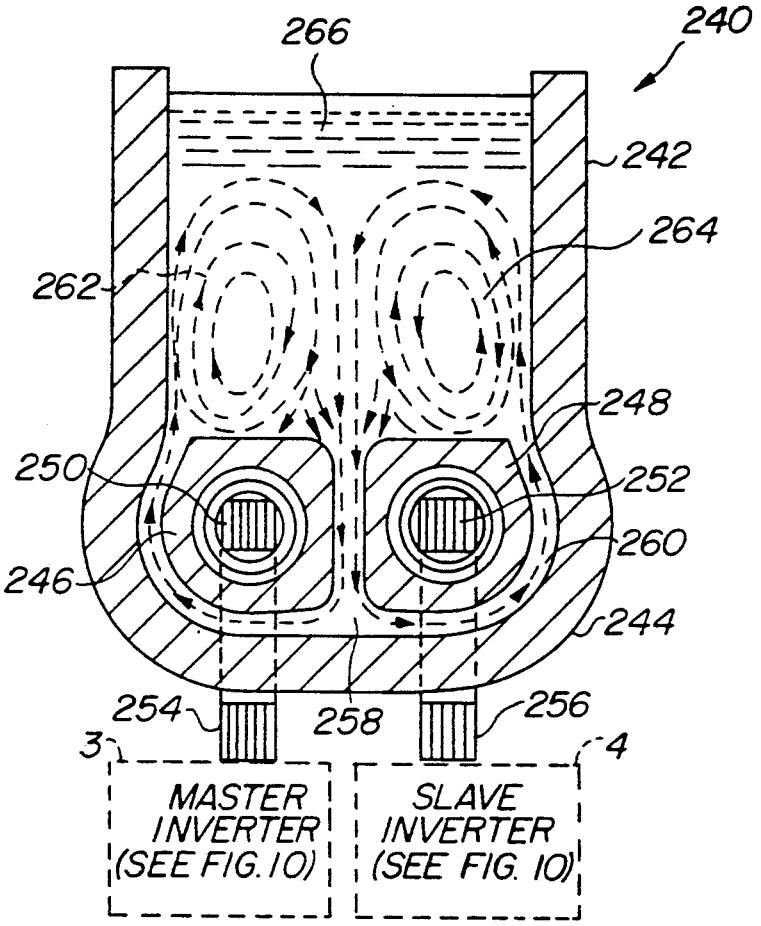
FIG. 9 illustrates a dual-loop channel type induction furnace having the benefits of the present invention.

A second embodiment of an induction furnace 240, employing the principles of the present invention, and using the waveshapes and pulses of FIG. 8 is shown in FIG. 9. The induction furnace 240 of FIG. 9 comprises a crucible 242 having a lower portion 244. The crucible 242 has provisions, shown as 246 and 248, for respectively housing coils 250 and 252. As known in the art, the location of these coils 250 and 252 within the crucible 242 and the cooperative interaction between coils 250 and 252, provide for a dual-loop, channel-type, induction furnace 240 shown in FIG. 9. The coils 250 and 252 are respectively connected to master inverter 3 and slave inverter 4 both shown in phantom in FIG. 9. The coil 250 is connected to the master inverter 3 by means of a feeder channel 254, whereas the coil 252 is connected to slave inverter 4 by means of a feeder channel 256.

The first (250) and second (252) coils are spaced apart from each other and also spaced apart from the lower portion 244 of the crucible 242 to provide a dual channel; with a first channel 258 being formed between the first (250) and second (252) coils, and a second channel 260 being formed between coils 250 and 252 and the lower portion 244 of the crucible 242. The operation on the inductive furnace 240 produces two different low-frequency, magnetic fields 262 and 264 both shown in FIG. 9 as circulating in opposite directions within a molten charge 266. The low-frequency magnetic fields produce a wave motion and a physical flow of the molten metal 266 which cooperate to form the commonly known stirring effect that induces the heating of the molten metal. This stirring effect developed by the plurality of coils 250 and 252 is enhanced by the present invention, and may be further described with reference to FIG. 10.

Figure 10:
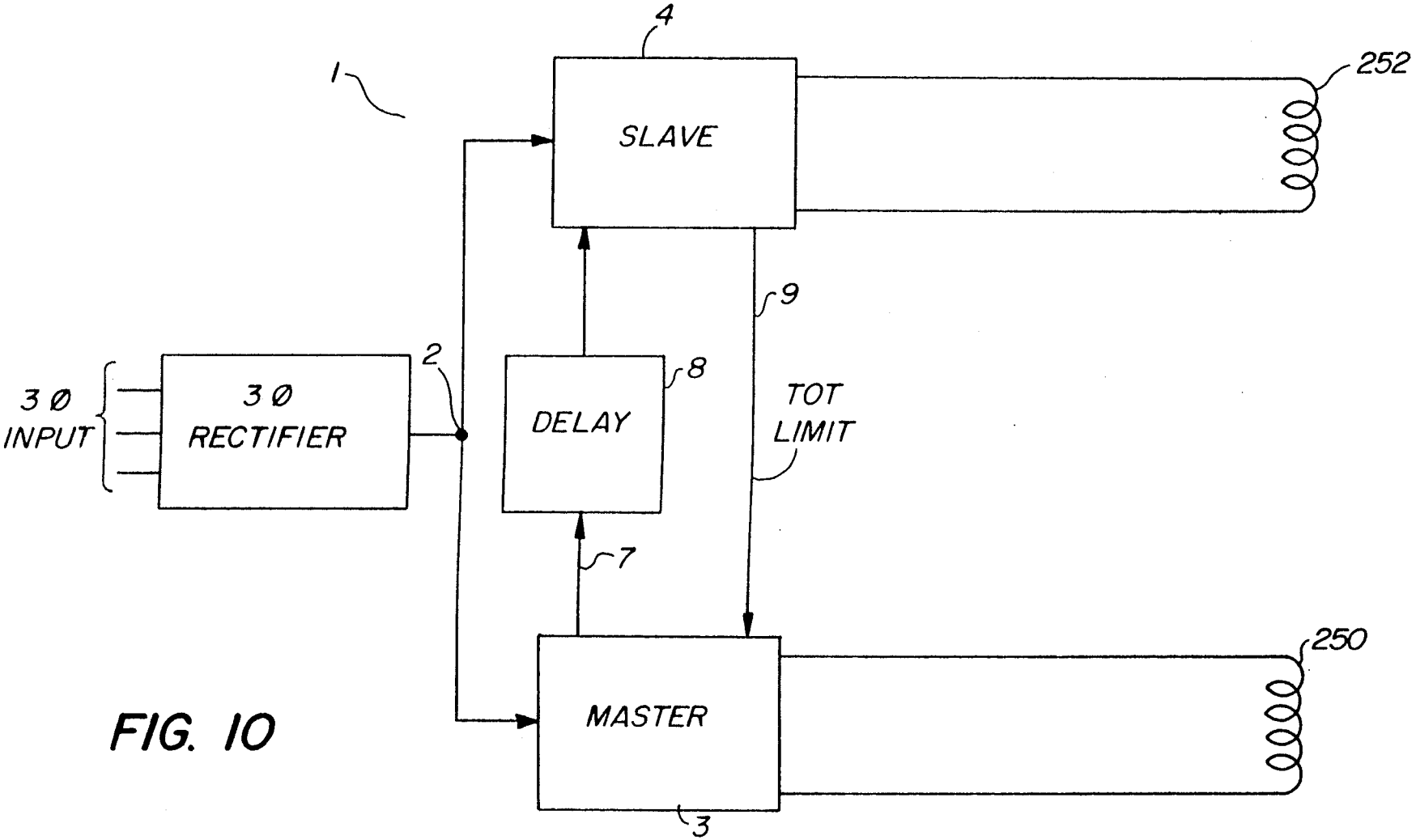
FIG. 10 is similar to FIG. 7, except it has been modified to show the interface to the induction furnace of FIG. 9.

The circuit arrangement of FIG. 10 is the same as that of FIG. 7, except that the master inverter 3 is now connected to coil 250, and the slave inverter 4 is now connected to coil 252. In general, the operation of the circuit arrangement of FIG. 10 varies the phase of the current supplied to coil 252 relative to that supplied to coil 250, so that the vertical running wave, previously described with reference to FIG. 7 and to be further discussed, is created in the molten charge 266. The electrical power supplied to slaved coil 252 can be shifted in phase up to approximately 90 degrees relative to the power supplied to 250. The phase shift quantity between the master and slave inverter, respectively supplying the coils 250 and 252, is shown as occurring between FIGS. 8(*a*) and 8(*f*) and also between FIGS. 8(*c*) and 8(*e*). The phase shift quantity shown as occurring in FIG. 8 is substantially less than 90 degrees, but the accumulative phase shift quantity of approximately 90 degrees is within the limits of this invention and is to be described hereinafter with reference to FIGS. 3–6.

The magnetic field comprised of circulating field 262 and 264 in the crucible 240 can exhibit a relative phase difference of 0, 90, 180, and 270 degrees from the bottom of the crucible to its top. As previously discussed and as is known in the art, such large and contiguous phase changes from bottom to top of the crucible advantageously creates an intense vertical running wave of molten metal material along the bottom of the crucible, up on side to its top, along the surface, and then back down the opposite side. The practice of the present invention, by varying the phase difference between the master and the slave inverter, provides multiphase stirring that creates this intense vertical running wave in the molten metal, so as to enhance the heating thereof.

It should now be appreciated, that the practice of the present invention, provides for the generation of a vertical running wave in the molten charge contained within the dual-loop, channel-type induction furnace. Further, it should be recognized, that although the channel inductive furnace 240 was described as being of a dual-loop type, the practice of this invention is equally applicable to other channel-type furnaces so long as the coils, such as 250 and 252 are arranged into opposite sets or pairs; e.g., four inductors arranged into two opposite pairs. The additional pairs of coils should be housed in the crucible, by appropriate provisions, with each such pair having one of its coils connected to the master inverter and its other coil connected to the slave inverter.

Figure 3:
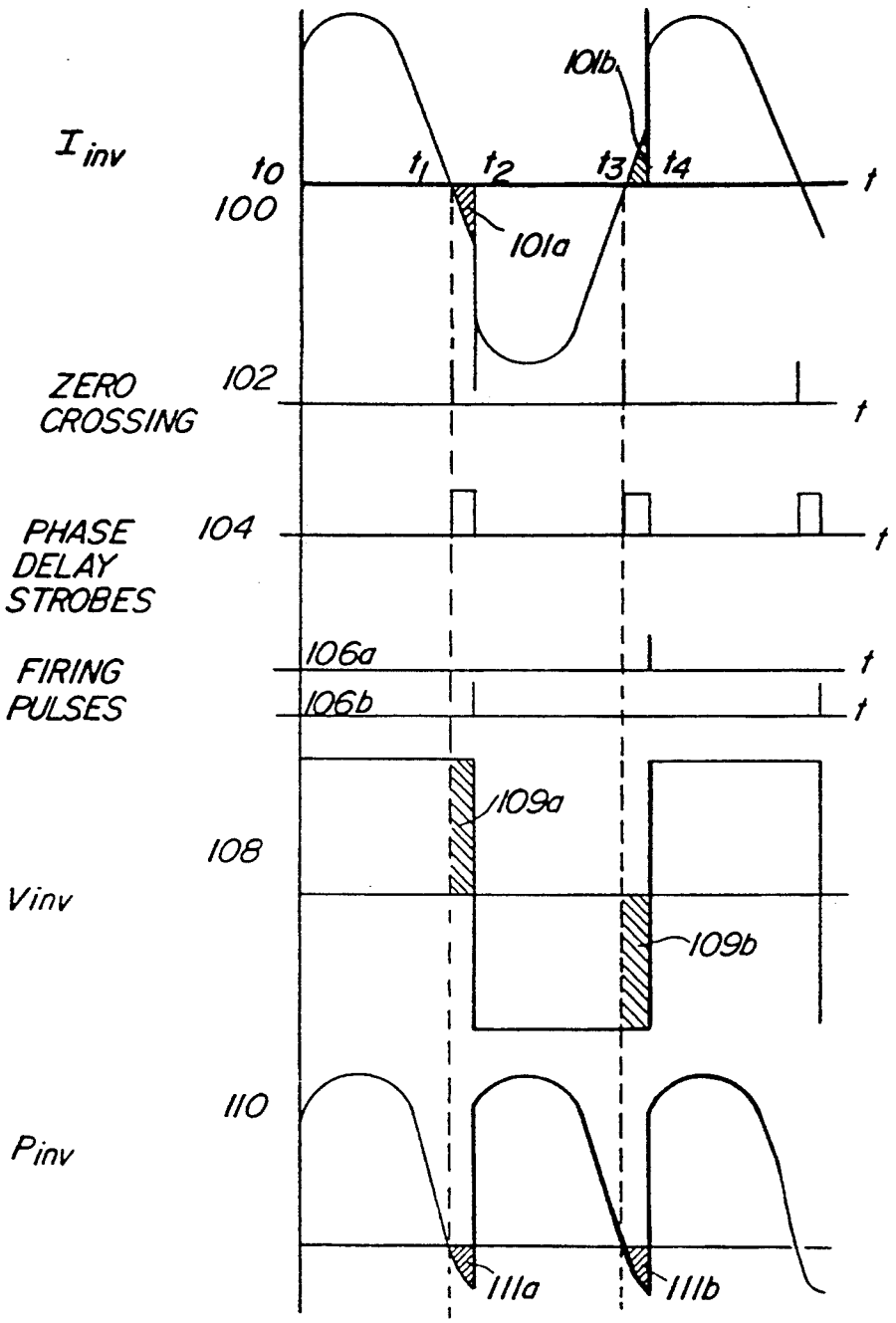
FIG. 3 is a series of waveforms present at various points in the inverter control system of the present invention.
Figure 4:
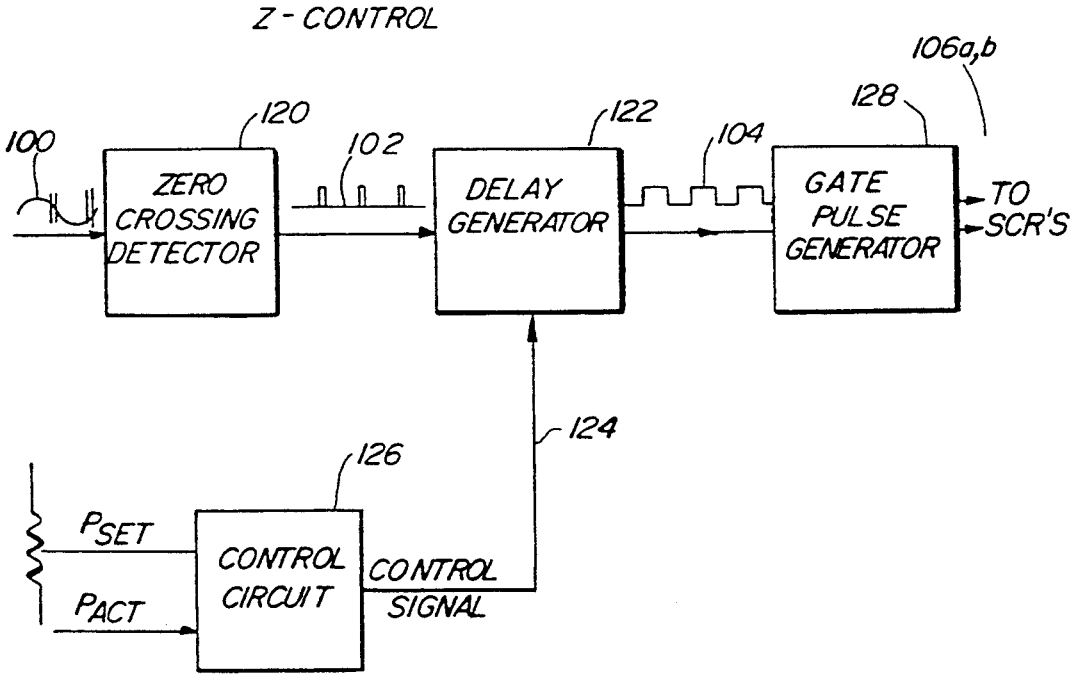
FIG. 4 is a simplified block diagram showing the basic elements of the inverter control system of the present invention.

Turning now to the detailed description of the inverter control circuitry so as to more fully describe the relative phase difference between the master and slave inverters, FIG. 4 is a block diagram showing the basic elements of such circuitry. These elements may be embodied electronically in any form, such as by analog circuit, digital circuit, or microprocessor. An analog embodiment is described below. FIG. 4, together with the waveforms of FIG. 3, illustrates the general principles by which the system controls inverter power in response to the resonant frequency of the load.

Curve 100 in FIG. 3 represents the current in the RLC load in response to the square-wave voltage. A first set of SCRs is fired at $t_0$. While there is a flow of energy into the RLC load, as between points $t_0$ and $t_1$, voltage accumulates on a capacitor, such as C of FIG. 1, and power is transferred to the melt charge. At point $t_1$, following the natural sinusoidal behavior of current in an RLC, the current crosses a zero point and becomes negative (i.e., changes direction), as seen in the shaded area marked 101*a*. A negative current flow causes the SCRs to turn off. During the turn-off period and before firing of the other set of SCRs, energy will be flowing back to a DC source, such as 12 of FIG. 2, instead of transferring to the melt charge.

The point of zero crossing of the current in the RLC is thus important because the zero crossing marks the point at which energy begins flowing back to the DC source. Energy will flow back to the source until the SCRs turn off. Once the SCRs have turned off, the other set of SCRs may safely be turned on. By turning on the other set of SCRs immediately after the first set has turned off, efficiency is maximized while preventing the short circuit condition previously discussed.

The current in the RLC is monitored by a zero-crossing detector, shown as box 120 in FIG. 4, which generates a strobe pulse at every zero crossing of the current in the RLC. This strobe pulse is shown as waveform 102 in FIGS. 3 and 4. As can be seen in FIG. 3, each strobe is synchronous with the zero-crossing of curve 100.

Zero-crossing strobe pulses 102 are then fed into a delay generator 122. Delay generator 122 produces a square pulse of a fixed duration in response to each incoming strobe pulse 102, as shown by waveform 104. This duration may be varied by a control signal 124.

Control signal 124 is produced by control circuit 126 in response to a difference signal, which is preferably related to the power associated with the RLC. Any parameter relevant to the particular operation, such as voltage or frequency, may also be used as the control parameter. Considering power as the relevant parameter to be controlled, the control circuit includes means for comparing the actual measured power in the RLC at a given time with a value preset by the operator. Typically, the preset power value will be chosen so as to prevent the power in the RLC from exceeding a safe level. The control circuit 126 produces a difference signal related to the instantaneous difference between power associated with the RLC and the preset value, and this difference signal is used to operate the control signal 124 sent to the delay generator 122.

If actual power detected in the RLC exceeds a preset value, the control signal causes the delay generator to increase the duration of each square pulse in waveform 104, causing an increase in the time between the zero crossing of current in the RLC and the firing of the other set of SCRs. An increase in this period means an increase in the time within each cycle during which energy is flowing back to the DC source, and therefore reducing the total amount of power passing to the melt charge within each cycle.

The output of the delay generator is sent to a gate pulse generator 128. Gate pulse generator 128 fires the appropriate pair of SCRs in response to the trailing edge of each square pulse of waveform 104. Because gate pulse generator 128 fires the pairs of SCRs in the bridge alternately, the firing pulses shown as waveform 106 in FIG. 3 are split so that every other pulse appears on one of two lines. Waveform 106*a*, for example, would fire SCRs 18*a*, 18*b* in the bridge of FIG. 2, and waveform 106*b* would fire the SCRs 20*a*, 20*b* of FIG. 2. The alternate firing of the pairs of SCRs in the full-bridge inverter causes the "chopped", or square-wave, voltage as shown in curve 108.

Although a full-bridge inverter is used to describe the principle of power control, the control system of the present invention can be used with any type of inverter, such as a half-bridge inverter or a digital device, wherein the sign changes of the chopped DC voltage can be externally controlled. With a digital or microprocessor-controlled inverter, it may not be necessary to split the firing pulses 106*a*, 106*b* into two trains, but the general principle of controlling the delay between the zero-crossing of the current and the sign change of the voltage is the same.

From a review of waveforms 100, 108, and 110 in FIG. 3, the method of power control of the present invention can be clearly seen. As curve 100 represents the current in the inverter ($I_{inv}$) over time, and curve 108 represents the voltage in the inverter ($V_{inv}$) over time, curve 110 represents power ($P_{inv}$) over time ($P=VI$) which is simply the product of curves 100 and 108. Between $t_1$ and $t_2$, after the zero crossing of current and before the firing of the alternate pair of SCRs, the current and voltage have opposite polarities. After $t_1$, current is negative while voltage remains positive, as can be seen in shaded area 109*a*. The product of a negative current and positive voltage yields a "negative" power, which is illustrated as shaded area 111*a* in curve 110 and which represents energy returned to the source. Similarly, between $t_3$ and $t_4$, the current is positive while the inverter voltage remains negative, as can be seen in shaded area 109*b* of curve 108. With a positive current and negative voltage, power will also be "negative", as seen in shaded area 111*b*. Power will be positive during those periods when current and voltage have the same polarity, whether positive or negative, representing energy transferred to the load.

However, when the voltage and current are of opposite polarity, power is "negative", i.e., no power is being transferred to the load and, instead, power stored in the RLC circuit is returned to the source. The duration of these periods of negative power is the same as that of each of the phase delay strobes in square pulse waves 104. By varying the duration of these delay strobes 104, the phase difference between voltage and current, and therefore the power, is directly regulated.

Figure 5:
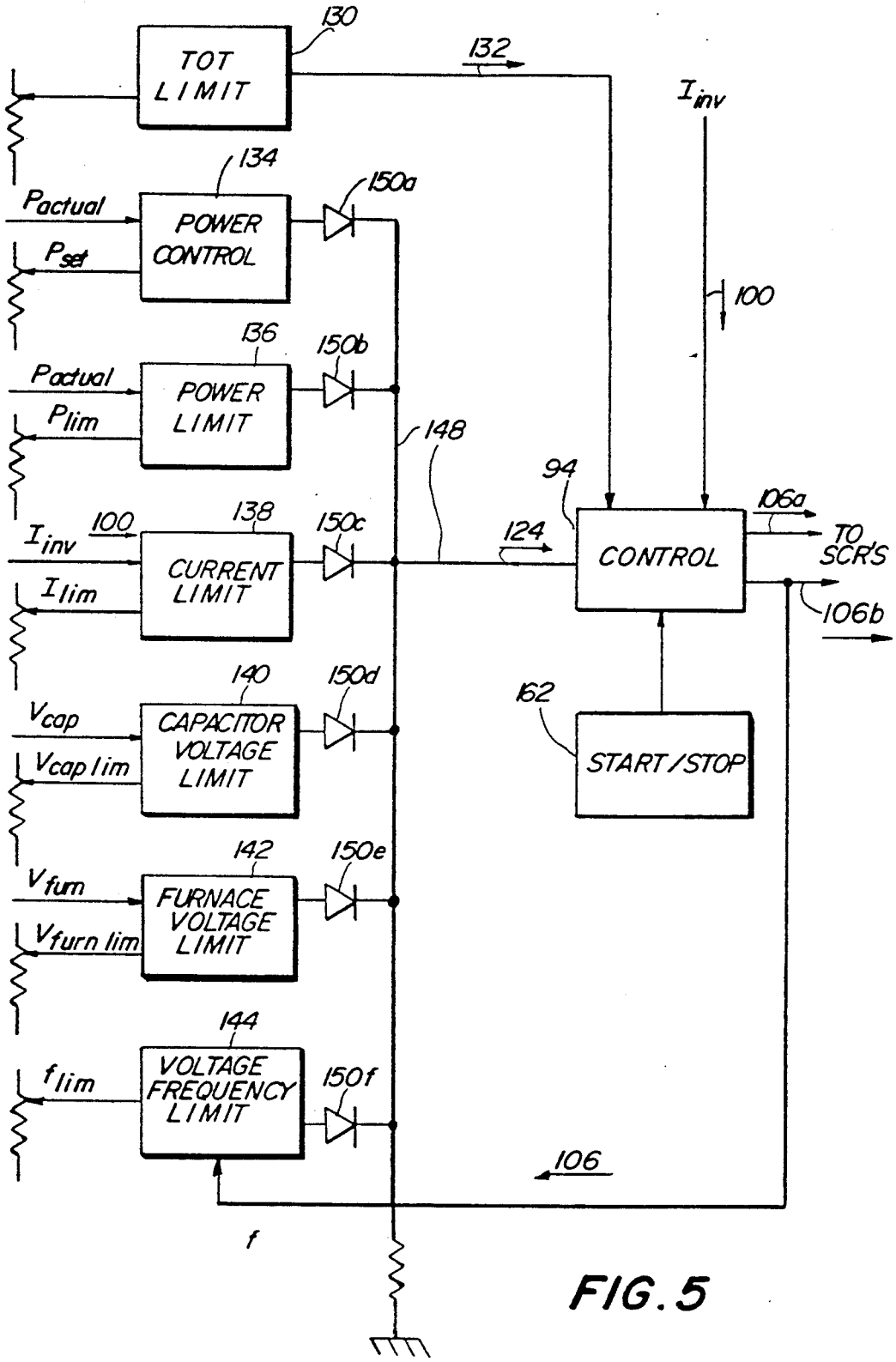
FIG. 5 is a simplified block diagram showing one embodiment of an inverter control system according to the present invention.

FIG. 5 is a block diagram showing one embodiment of the control circuitry, wherein the limits to various parameters are set by analog means and the firing pulses are split between two channels.

The zero crossing detector 120, delay generator 122 and gate pulse generator 128 are shown as one module 94 labeled "CONTROL". Input into the control module 94 are the inverter current (waveform 100 in FIG. 3), control signal 124 (as in FIG. 4), a start/stop signal generated by device 162 of FIG. 5, and a TOT limit signal 132, which will be explained below. Output from control module 94 are two lines which carry the split-channel firing pulses 106*a*, 106*b* applied to the SCRs of FIG. 2.

In the embodiment shown in FIG. 5, the control signal 124, which controls the delay generator 122 in control module 94, is a combination of a number of difference signals, each difference signal corresponding to a parameter of the circuit. These signals are derived from individual modules: power control module 134; power limit module 136; current limit module 138; capacitor voltage limit module 140; furnace voltage limit module 142; and voltage frequency limit module 144. Each of the modules monitors a parameter of the circuit and compares it with a preset value for that parameter to produce a difference signal. The difference signal from each device is passed through a common line 148, each individual difference signal passing through one of the diodes 150*a*–*f*. The combined difference signal on line 148 forms control signal 124. The individual modules for each parameter preferably comprise active circuit elements, such as comparators.

The power control module 134 may accept as inputs either a direct power measurement, or may accept separate inputs of voltage and current. In the latter case, the separate voltage and current inputs are multiplied to obtain a power signal. The input flexibility of the power control module 134 permits the control system of the present invention to be installed on pre-existing equipment. Some equipment is adapted for direct measurement of power, while other types of equipment have separate lines for voltage and current. When separate inputs of voltage and current are used, it is preferable to filter both signals through separate differential amplifiers to remove common-mode noise. Current and voltage may be multiplied with an analog multiplier and then integrated with an integrator to yield a power signal. The power signal is then amplified and compared to the set power signal determined by the operator. The set power signal is generated on an external potentiometer. The set power signal is filtered to dampen quick changes by the operator. The set power signal and the actual power signal (whether directly measured or obtained by multiplying voltage and current) are compared in a differential amplifier/integrator within module 134, which produces the resultant error signal on common line 148.

While the power control module 134 maintains the power near a preset level, power limit module 136 prevents the power in the load from exceeding a preselected amount. The power limit module 136 monitors load power in the same ways as power controller 134, and compares it to a power limit signal set by the operator through an external potentiometer. The actual power at a given time will be either lower than the limit signal, producing a negative difference signal, or greater than the limit signal, producing a positive difference signal. In the power limit module 136, the negative difference signal is ignored. The power limit module 136 produces a difference signal only when the measured power exceeds the preset power limit.

Current limit module 138 receives as its input the current from the inverter (waveform 100 in FIG. 3). The input is filtered to provide an average inverter current signal which is compared with a preset current limit. As with the power limit signal, actual current values below the preset limit are ignored, and a difference signal is produced only when inverter current exceeds the preset limit.

Capacitor voltage limit module 140 measures the voltage on the capacitor (such as C of FIG. 1), rectifies and filters this voltage to determine an average voltage signal, and then compares the average voltage signal to a preset limit, producing a difference signal if the actual voltage exceeds the preset limit. Furnace voltage limit module 142 performs the same function, except that it monitors the voltage associated with the inductor coil (such as L of FIG. 1).

Voltage frequency limit module 144 receives as an input the firing pulses 106*a* or 106*b* generated by the control module 94. For the embodiment shown in FIG. 5, module 144 receives firing pulse 106*b*. Two pulses are produced for each cycle of the DC square wave one on each channel, and the pulses on one of the channels will have the same frequency as the RLC load. The output of one of the channels (106*a* or 106*b*) is monitored by the voltage frequency limit module 144, where the input pulses are filtered to produce a DC voltage directly proportional to the frequency of the firing pulses and, hence, the frequency of the inverter. This DC voltage is compared with a preset limit, and, as with the other limit modules, a difference signal will be produced only when the measured frequency exceeds the preset limit.

It will thus be appreciated that, in addition to a power control module 134 which controls the power associated with the RLC to a desired value, the circuitry includes a number of limit modules 136–144, which monitor the power and other parameters to prevent each of these parameters and the power from exceeding a preset limit. These other parameters are controlled independently depending on a particular situation. For example, the capacitor in the RLC load will typically have specific maximum allowable voltage and frequency limits peculiar to the capacitor which may not be accounted for by regulating the power alone. Thus, although only power is actually controlled, individually limiting the other parameters is important as well.

In addition to control signal 124, which represents a combination of the control signals from all of the modules, the control module 94 also receives as an input a TOT limit signal 132 which is produced by a TOT limit module 130. The TOT, or "turn-off-time", limit represents a minimum difference signal corresponding to a minimum period of negative energy flow within each cycle of the inverter to prevent it from shorting. As mentioned above, if the alternate pair of SCRs is fired before the turn-off-time (TOT) of the first pair of SCRs, the inverter will short. The TOT limit module 130 will provide a minimum difference signal so that the alternate pair of SCRs will always fire after the turn-off-time of the first pair of SCRs, when the first pair of SCRs have returned to the OFF state.

The control module 94 also receives inverter current as a direct input to monitor the zero-crossing points of the inverter current. Control module 94 also has provision for start/stop means 162, which is explained in detail below.

Figure 6:
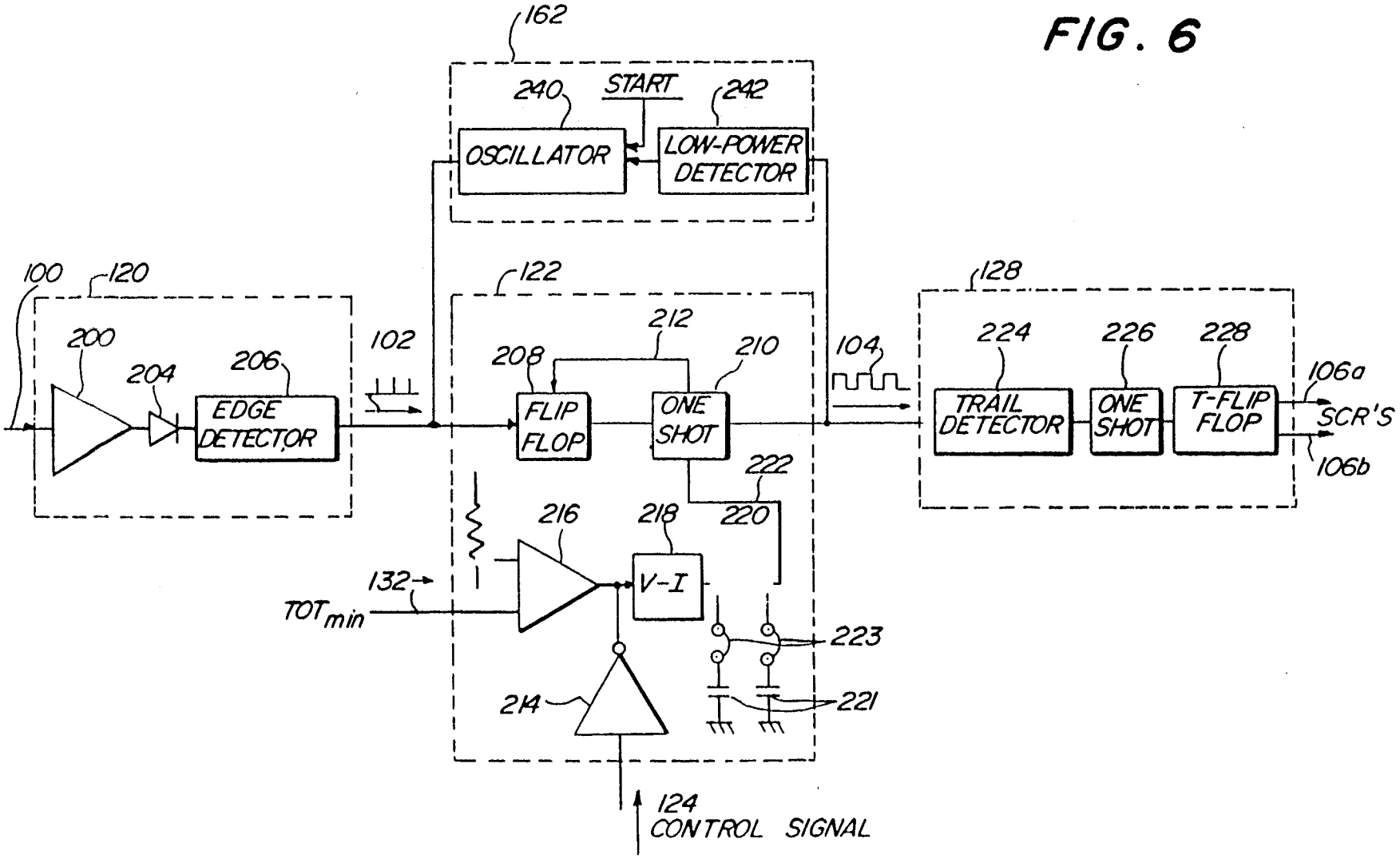
FIG. 6 is a block diagram showing the elements shown in FIG. 4 in greater detail.

FIG. 6 is a detailed diagram showing the primary internal portions of zero crossing detector 120, delay generator 122, and gate pulse generator 128 and the start/stop means 162. In this embodiment, zero crossing detector 120 comprises a comparator 200, a diode 204, and an edge detector circuit 206. Waveform 100, representing the current in the RLC load, is fed into comparator 200. Comparator 200 outputs a constant positive voltage when the incoming current is greater than zero, and an equal amplitude but negative constant voltage when the incoming current is less than zero. The output of comparator 200 is thus a square wave voltage. The negative portion of this signal is cut off by diode 204 and the resulting square wave, varying between a positive voltage and zero, is fed into an edge detector 206, which may take the form of a Schmitt trigger. Each edge of the square wave corresponds to a zero crossing of the current. Edge detector 206 produces a strobe upon every leading and trailing edge of the square wave. These strobes become waveform 102 and are passed to the delay generator 122.

Delay generator 122 comprises flip-flop 208, one-shot 210, voltage-to-current (V-I) convertor 218, a plurality of timing capacitors 220, an inverter 214 and a comparator 216. Timing capacitors 220 may be in the form of a series of capacitors 221, selected by jumpers 223 for proper frequency range. Zero crossing strobes 102 are entered into flip-flop 208, which passes the signal to one-shot 210. One-shot 210 preferably comprises a clamping line 212 connected to flip-flop 208, which will block further inputs to flip-flop 208 for a delay period of a certain duration. This blocking feature assures that no false zero crossing signal will trigger the flip-flop 208 at an inappropriate time.

Control signal 124 is inputted into inverter 214, and the inverted signal is combined with a preselected minimum turn-off-time signal 132 which, as explained above, provides a minimum difference signal to ensure a minimum delay time between zero crossing and firing of the SCRs. The minimum turn-off-time signal 132 is passed through comparator 216, which allows for fine adjustments. The combined control signal (minimum turn-off-time signal 132 and the control signal 124) is entered into a voltage-to-current converter 218, which produces a current proportional to the voltage of the combined control signal. This current charges timing capacitors 220. The greater the voltage of the control signal entered into converter 218, the greater the output current, and the faster the timing capacitors will charge. The timing capacitors 220 are connected to one-shot 210 through line 222. Upon receiving a signal from flip-flop 208, one-shot 210 will produce a positive voltage, and will also unclamp line 222, allowing timing capacitors 220 to charge with current from converter 218. The positive voltage output will be turned off only when the charge on timing capacitor 220 reaches a threshold amount. As the rate of charging of the timing capacitors depends on the current produced by converter 218, which in turn is proportional to the control signal, the length of time one-shot 210 will output a positive voltage is directly dependent on the control signal 124. This positive voltage forms the delay pulses 104, which are sent to gate pulse generator 128.

Gate pulse generator 128 comprises a trail detector 224, a one-shot 226, and a T flip-flop 228. Trail detector 224 detects the trailing edge of each of the delay pulses 104. The trailing edges of delay pulses 104 indicate the times at which a pair of SCRs should be fired. Trail detector 224 produces strobes which trigger one-shot 226, which produces standard SCR firing pulses. These firing pulses are divided into two strings by T flip-flop 228. Every strobe pulse entered into T flip-flop 228 alters the state of the T flip-flop 228, which in turn alternately fires one pair of SCRs. Thus, with every trailing edge of delay pulses 104, a firing pulse **106*a* or 106*b* is output from alternate outputs of the T flip-flop 228**.

In using the control system of the present invention, there is a danger of causing a short in the inverter when the apparatus is being started or stopped. A number of cycles will be required before the control system adapts to the frequency associated with the RLC load. Control module 94 (shown in FIG. 5) thus includes means 162 (shown in FIG. 6) for safely starting and stopping the control system by means of an oscillator 240 which initiates simulated zero crossing strobes to the delay generator 122. On starting, the simulated strobes are generated while inhibiting the power reference voltage entered into power control module 134 (shown in FIG. 5). In this way, inverter operation is simulated before power is actually passed through the inverter to the RLC load. By starting the control system in advance by means of oscillator 42 of start/stop means 162, there is no danger of a short while the inverter "finds" the appropriate operating frequency for a particular melt charge. To stop the apparatus, the start/stop means 162 detects a low power to the inverter by means of detecting delay pulses 104 of a certain duration associated with a low level of power. At low power, the oscillator 240 is once again triggered to initiate artificial zero crossing pulses to delay generator 122, and the power is allowed to ramp down to the low idle frequency produced by the oscillator 240 so that it may be safely stopped.

It should now be appreciated that the practice of the present invention provides an inverter control system that safely and efficiently delivers power to various types of inductive furnaces.

The present invention may be embodied in other specific forms without departing from the spirit or essential attributes thereof and, accordingly, reference should be made to the appended claims, rather than to the foregoing specification, as indicating the scope of the invention.

I claim:

1. A channel-type induction furnace comprising: a crucible having a lower portion housing at least a first and a second induction coil, said induction coils between separated from each other and from said lower portion so to provide at least a dual-channel with the first channel being between the coils themselves, and the second channel being between the induction coils and the lower portion;

first and second inverters each having switch means with known turn-off-time characteristics for generating an alternating polarity output voltage across a load, the first inverter being connected to said first induction coil, and the second inverter being connected to said second induction coil;

means associated with the first inverter for monitoring the current and detecting zero-crossing of the current in said first induction coil, and for generating a control signal in response to such detection of zero-crossing, said means generating the control signal at an interval following detection of the zero-crossing which is greater than the turn-off-time characteristic of the switch means;

means for supplying the control signal to the switch means of the inverters to change the polarity of the inverter voltage in response to said signal;

means associated with the second inverter for introducing a selectable delay of said control signal to the switch means of the second inverter to produce a relative phase difference between the output voltages of the first and second inverters.

2. A channel-type induction furnace according to claim 1, wherein said lower portion of said crucible houses a plurality of induction coils arranged into pairs with one of each of said pairs being connected to said first inverter and the other of each of said pairs being connected to said second inverter.

3. A channel type induction furnace according to claim 2, wherein the means associated with the second inverter for introducing a selectable delay of the control signal is capable of producing a relative phase difference of up to approximately 90 degrees between the output voltages of the first and second inverters which, in turn, produces a relative phase difference of up to approximately 90 degrees between each of the coils in each of the pairs of induction coils housed in said crucible.

4. A channel-type induction furnace according to claim 1, wherein the means associated with the second inverter for introducing a selectable delay of the control signal is capable of producing a relative phase difference of up to approximately 90 degrees between the output voltages of the first and second inverters.

5. An induction furnace comprising:

a crucible;

a plurality of induction coils surrounding the crucible;

first and second inverters each having switch means with known turn-off-time characteristics for generating an alternating polarity output voltage across a load, the first inverter being connected to a first set of the induction coils, and the second inverter being connected to a second set of the induction coils;

means associated with the first inverter for monitoring the current and detecting the zero-crossing of the current in the first set of induction coils, and for generating a control signal in response to such detection of zero-crossing, said means generating the control signal at an interval following detection of the zero-crossing which is greater than the turn-off-time characteristic of the switch means;

means for supplying the control signal to the switch means of the inverters to change the polarity of the inverter voltage in response to said signal, means associated with the second inverter for introducing a selectable delay of said control signal to the switch means of the second inverter to produce a relative phase difference between the output voltage of the first and second inverters.

6. An induction furnace as in claim 5, wherein the switch means are silicon controlled rectifiers, and wherein the control signal is a gate pulse.

7. An induction furnace as in claim 5, wherein said means for generating a control signal further comprises:

means for comparing power supplied to the first set of induction coils to a preset power level and for decreasing the interval when the supplied power is less than the preset power level.

8. An induction furnace as in claim 7, wherein the switch means are silicon controlled rectifiers, and wherein the control signal is a gate pulse.

9. An induction furnace as in claim 7, further comprising means for preventing further decrease of the interval whenever one or more parameters related to the load of the first inverter exceed a preselected limit.

10. An induction furnace as in claim 9, wherein such parameters may be selected from the group comprising:

load power, inverter current, capacitor voltage, induction coil voltage, and voltage frequency.

11. An induction furnace as in claim 9, wherein there are four induction coils vertically separated from each other around the crucible, the first set having two coils and the second set the other two coils, the first set coils connected in parallel to each other but wound in opposite directions around the crucible, the second set coils being connected in parallel to each other but wound in opposite directions around the crucible, and one of the second set coils being located between the first coils such that the coils wound in the same direction are adjacent to each other.

12. An induction furnace as in claim 11, wherein the means associated with the second inverter for introducing a selectable delay of the control signal is capable of producing a relative phase difference up to approximately 90 degrees between the output voltage of the first and second inverters.

13. An induction furnace as in claim 7, wherein there are four induction coils vertically separated from each other around the crucible, the first set having two coils and the second set the other two coils, the first set coils connected in parallel to each other but wound in opposite directions around the crucible, the second set coils being connected in parallel to each other but wound in opposite directions around the crucible, and one of the second set coils being located between the first coils such that the coils wound in the same direction are adjacent to each other.

14. An induction furnace as in claim 13, wherein the means associated with the second inverter for introducing a selectable delay of the control signal is capable of producing a relative phase difference up to approximately 90 degrees between the output voltage of the first and second inverters.

15. An induction furnace as in claim 5, wherein there are four induction coils vertically separated from each other around the crucible, the first set having two coils and the second set the other two coils, the first set coils connected in parallel to each other but wound in opposite directions around the crucible, the second set coils being connected in parallel to each other but wound in opposite directions around the crucible, and one of the second set coils wound in the same direction are adjacent to each other.

16. An induction furnace as in claim 15, wherein the means associated with the second inverter for introducing a selectable delay of the control signal is capable of producing a relative phase difference up to approximately 90 degrees between the output voltage of the first and second inverters.

17. A method of controlling the power supplied to an induction furnace by two or more inverters, each having switch means responsive to a control signal for generating an alternating polarity voltage across a load, said switch means having known turn-off-time characteristics, and in which furnace a first inverter is connected to supply power to a first set of induction coils, and each other inverter is connected to supply power to a different associated set of induction coils, comprising the steps of:

monitoring the current in the induction coils supplied by the first inverter, detecting the zero-crossings of said current, generating a switch means control signal after a delay interval of predetermined duration following detection of each zero-crossing of the current, the duration of the delay interval being greater than the turn-off time of the switch means, supplying the control signal to the switch means of each of the inverters to supply power to each of the induction coils which is essentially in phase coincidence with the power supplied to each other coil, operating the induction coils in phase coincidence until a significant portion of a metal charge in the furnace melted, then delaying the control signals supplied to the switch means of the inverters other than the first inverter by a selected interval to create a relative phase difference between the induction coils sufficient to produce stirring wave motion in a melted metal charge.

18. A method as in claim 17, further comprising the steps of:

determining the duration of the delay interval by comparing the power supplied to the first set of induction coils to a preset power level, and decreasing the duration of the interval when the supplied power is less than the preset power level.

19. A method as in claim 18, further comprising the steps of:

comparing one or more parameters related to the load of the first inverter to a preselected limit, and preventing decrease in the duration of the delay interval when a parameter exceeds its preselected limit.

20. A method of controlling the power supplied to an induction furnace by two inverters, each having switch means responsive to a control signal for generating an alternating polarity voltage across a load, said switch means having known turn-off-time characteristics, in which furnace there are four induction coils vertically separated from each other around a crucible, a first inverter is connected to supply power to a first pair of the induction coils, and the second inverter is connected to supply power to a second pair of the induction coils, the first pair of coils being connected in parallel to each other but wound in opposite directions around the crucible, the second pair of coils being connected in parallel to each other but wound in opposite directions around the crucible, and one of the second pair coils being located between the first pair coils such that the coils wound in the same direction are adjacent to each other, comprising the steps of:

monitoring the current in the first pair induction coils, detecting the zero-crossings of said current, generating a switch means control signal after a delay interval of predetermined duration following detection of each zero-crossing of the current, the duration of the delay interval being greater than the turn-off time of the switch means, sending the control signal to the switch means of both inverters to supply the second pairs of induction coils with power that is essentially in phase coincidence with the power supplied to the first pair, operating the induction coils in such phase coincidence until a portion of a metal charge in the crucible has melted, then delaying the control signals supplied to the switch means of the second inverter by a selected interval to create a relative phase difference between the induction coils sufficient to produce stirring wave motion in the melted metal charge.

21. A method as in claim 20, further comprising the step of progressively delaying the control signal supplied to the switch means of the second inverter until the relative phase difference between the induction coils is sufficient to produce a running wave from the bottom of the crucible to the surface of the melted metal.

22. A method of controlling the power supplied to an induction furnace by two inverters, each having silicon controlled rectifiers (SCR) responsive to a gate signal for generating an alternating polarity voltage across a load, and said SCRs having a known turn-off-time, in which furnace there are four induction coils vertically separated from each other around a crucible, a first inverter is connected to supply power to a first pair of the induction coils, and the second inverter is connected to supply power to a second pair of the induction coils, the first pair of coils being connected in parallel to each other but wound in opposite directions around the crucible, the second pair of coils being connected in parallel to each other but wound in opposite directions around the crucible, and one of the second pair coils being located between the first pair coils such that the coils wound in the same direction are adjacent to each other, comprising the steps of:

monitoring the current in the first pair of induction coils, detecting the zero-crossings of said current, generating a gate signal after a delay interval following the generation of each signal pulse, comparing the power supplied to the first pair of induction coils to a preset power level, reducing the duration of the delay interval when the power supplied is less than the preset power level, limiting the minimum duration of the delay interval to a duration greater than the turn-off time of the SCRs, supplying the gate signals to alternating SCRs in each inverter to change the polarity of the inverter voltages at essentially the same time to supply power to the second pair of induction coils which is essentially in phase coincidence with the power supplied to the first pair, operating the induction coil pairs essentially in such phase coincidence with each other until a portion of a metal charge in the crucible has melted, then progressively delaying the gate signals supplied to the SCRs of the second inverter by a selected interval to create a phase difference between the induction coils sufficient to produce stirring wave motion in the melted metal charge.

* * * * *